United States Patent [19]

Grimsby et al.

[11] 4,291,502

[45] Sep. 29, 1981

[54] GRINDING OR POLISHING TOOL

[75] Inventors: Emerson A. Grimsby, Brea; Stanley W. Levasheff, Huntington Beach, both of Calif.

[73] Assignee: International Telephone and Telegraph Corporation, New York, N.Y.

[21] Appl. No.: 78,520

[22] Filed: Sep. 24, 1979

[51] Int. Cl.[3] ..... B24B 7/00

[52] U.S. Cl. ..... 51/120; 51/125; 51/128; 144/28.6

[58] Field of Search ..... 51/119, 120, 125, 128, 51/216 R, 217 R, 227 R, 227 H, 266; 144/28.4, 28.6, 28.72; 407/200, 231

[56] References Cited

U.S. PATENT DOCUMENTS

| | | | |
|---|---|---|---|
| 1,972,086 | 9/1934 | Buckley | 51/120 |
| 2,371,582 | 3/1945 | Hanchett | 51/120 X |
| 2,520,523 | 8/1950 | Bloomquist | 51/227 H |
| 3,059,617 | 10/1962 | Swimmer et al. | 144/28.72 |
| 3,137,977 | 6/1964 | Graves | 51/119 |
| 3,513,599 | 5/1970 | Hubrich | 51/128 |
| 3,667,516 | 6/1972 | Grosjean | 144/28.72 X |
| 3,742,652 | 7/1973 | Enders | 51/128 X |
| 3,753,320 | 8/1973 | Wurscher | 51/128 X |

*Primary Examiner*—Gary L. Smith
*Assistant Examiner*—Robert P. Olszewski
*Attorney, Agent, or Firm*—Thomas L. Peterson

[57] ABSTRACT

A tool is disclosed for precisely grinding or polishing the surface of a workpiece, such as the mating end face of a fiber optic ferrule. The tool utilizes a planar grinding wheel which is caused to rotate and simultaneously shift transversely in the plane in which it lies by the use of an eccentric driving connection to the wheel and gear teeth on the outer surface of the wheel and gear teeth on the interior of the chamber in which the wheel is mounted. Such movement of the wheel causes the workpiece to be ground in multiple directions across its face.

6 Claims, 5 Drawing Figures

FIG. 4
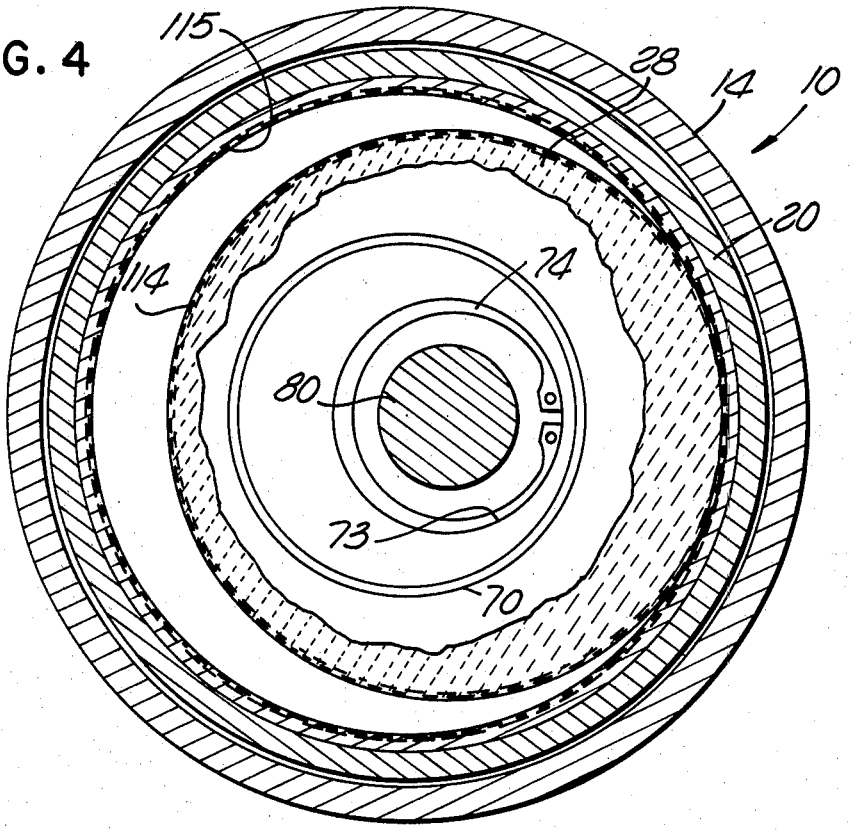
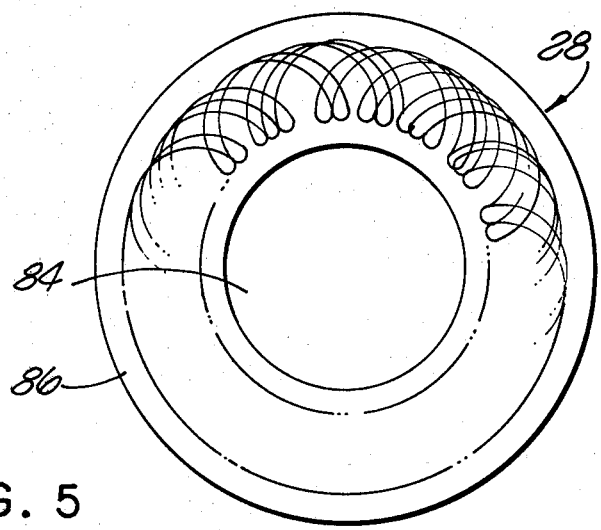
FIG. 5

GRINDING OR POLISHING TOOL

The Government has rights in this invention pursuant to Contract No. N6601-78-C-0035 awarded by the Department of the Navy.

BACKGROUND OF THE INVENTION

The present invention relates generally to a tool for grinding or polishing the surface of a workpiece and, more particularly, to such a tool which is particularly suited for grinding or polishing the mating end face of a fiber optic ferrule.

In the art of optical fiber connectors, it is common to use a pair of ferrules each connected to a single optical fiber or fiber optic bundle and assemblying the ferrules in a suitable alignment mechanism with the mating end faces thereof in abutting relationship in order to transmit optical signals therethrough. It is important that the mating end faces of the ferrules be precisely perpendicular to their longitudinal axes and smooth in order that the fibers therein may abut in intimate contact to minimize light transmission losses through the connection assembly.

It is common practice to grind or polish the end face of a ferrule by hand by moving the ferrule in the path of a figure "8" over a grinding or polishing surface. This motion causes the ferrule to be lapped in multiple directions across its end face. That is, the grinding surface passes over the end face from essentially all points about its perimeter. As a result, a smooth, flat surface is achieved. However, such hand operation is relatively slow and uncontrolled. It is also known in the art to utilize a grinding or polishing tool in which a planar grinding or polishing wheel is rotated in a cylindrical chamber with the ferrule mounted in the upper wall of the chamber over the wheel. In order to avoid the wheel being non-uniformly worn by the ferrule engaging only one area of the wheel, it is known to mount the ferrule on a pivoted arm and translate the arm so that the ferrule moves in an arc across one side of the wheel. While this arrangement avoids the non-uniform wear problem of the wheel, the end face of the ferrule is ground in only one direction, which may result in chipping of the edge of the fiber, and normally does not provide as smooth a surface as when the ferrule is subjected to a multi-direction cross grinding or polishing action.

Thus, what is desired, and constitutes the principal object of the present invention, is a grinding or polishing tool which will effect a multi-direction cross grinding or polishing action on the surface of a workpiece automatically without excessive wear of the wheel. Another object of the invention is to provide a tool which will provide a flat, smooth surface on the end of an elongated workpiece which is precisely perpendicular to the center axis of the workpiece.

SUMMARY OF THE INVENTION

According to the principal aspect of the present invention, there is provided a grinding or polishing tool incorporating means which causes the grinding or polishing wheel thereof to rotate and simultaneously move transversely in the plane in which it lies underneath a workpiece mounted on the tool housing so that the workpiece will be ground or polished in multi-directions across its face, rather than in a single direction as in prior art automated tools of this type. In a preferred embodiment of the invention, the wheel is driven through an eccentric driving connection to shift the wheel transversely while the wheel is being rotated about its center axis by the engagement of gear teeth on its outer surface with gear teeth on the inner surface of the housing.

According to another aspect of the present invention, the grinding or polishing wheel of a tool is formed with a raised bearing surface facing a datum or reference surface on the top of the tool housing which is machined precisely perpendicular to the center axis of the workpiece holder on the housing. The wheel is biased upwardly so that the bearing surface thereon is maintained in engagement with the reference surface. Thus, wobbling or bouncing of the wheel is avoided and the grinding or polishing surface of the wheel will be exactly perpendicular to the workpiece when the wheel is rotated in the housing.

BRIEF DESCRIPTION OF THE DRAWINGS

FIG. 4 is a transverse sectional view taken along line 4—4 of FIG. 3; and FIG. 5 is a top plan view of the grinding or polishing wheel utilized in the tool of the present invention showing the pattern of movement of the wheel with respect to the workpiece.

DESCRIPTION OF THE PREFERRED EMBODIMENT

Figure 1:
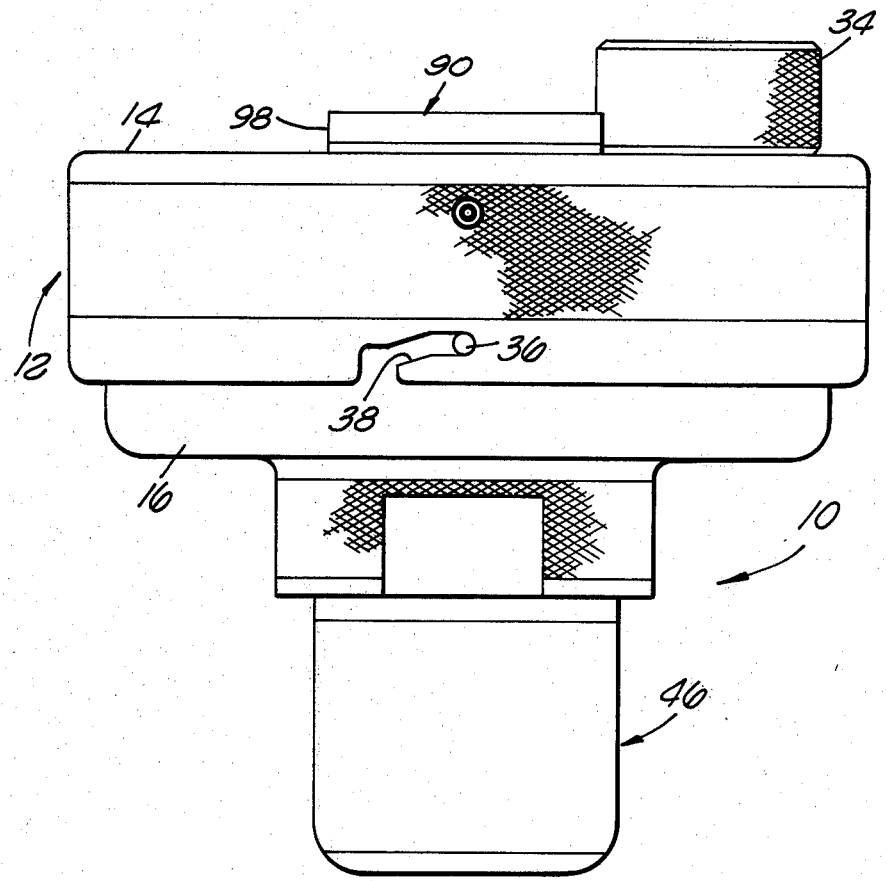
FIG. 1 is a side view of the tool of the present invention.
Figure 2:
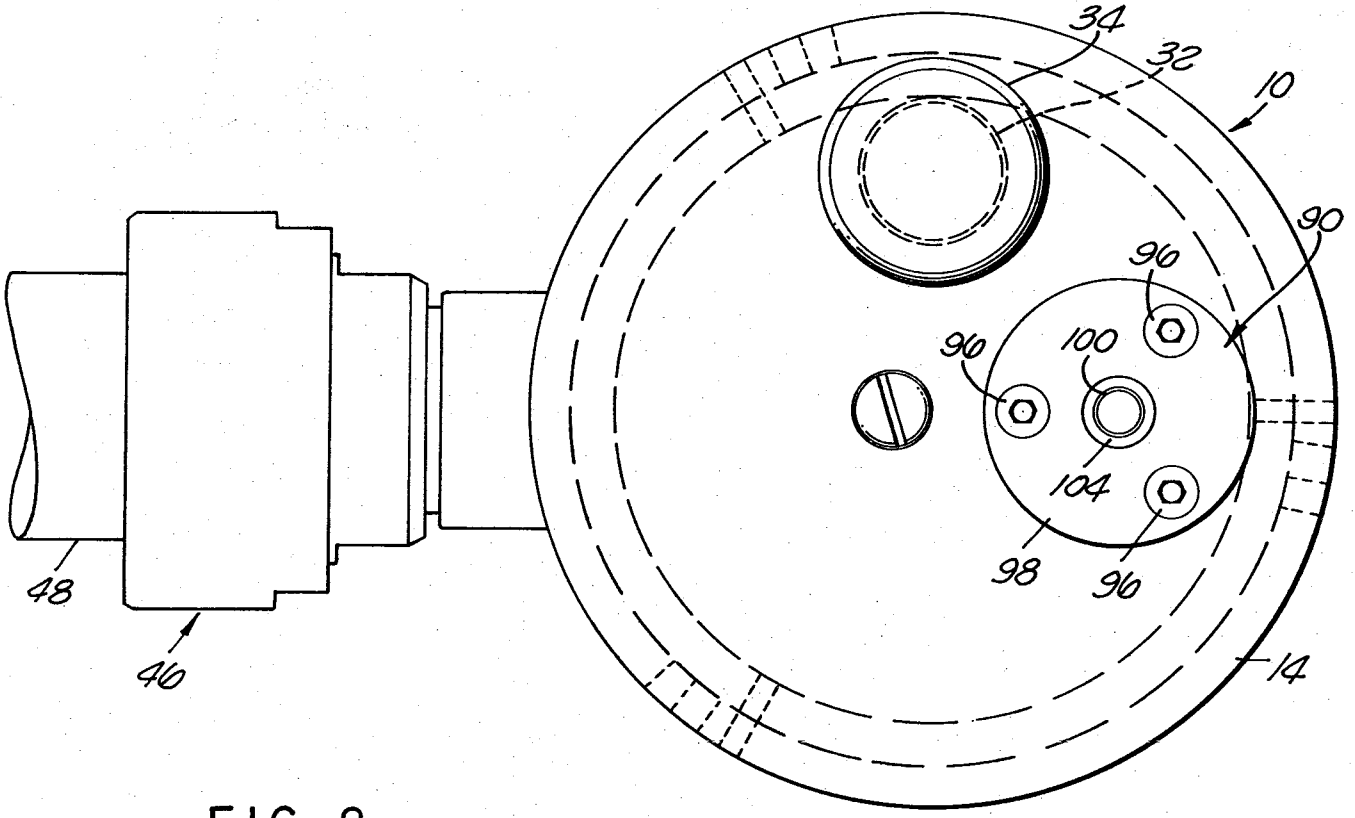
FIG. 2 is a top plan view of the tool.

Referring now to the drawings in detail, the tool of the present invention, generally designated 10, comprises a housing 12 consisting of an upper part or cover 14 and a lower part 16. The lower part of the housing includes a generally flat lower wall 18 and a cylindrical sidewall 20. The cover 14 provides an upper wall 22 and a skirt 24 which surrounds the cylindrical wall 20 when the cover is mounted on the lower part of the housing. The upper and lower parts of the housing define a cylindrical chamber 26 in which there is rotatably mounted a planar grinding or polishing wheel 28. An annular O-ring 30 provides a seal between the upper and lower parts of the housing to close the chamber. As seen in FIG. 2, a slurry or lubricant fill port 32 is provided in the cover 14. The port is closed by a threaded cap 34. The cover may be threaded onto the lower part 16 of the housing but preferably, is retained thereon by a quick, releasable bayonet coupling arrangement, as provided by a plurality of bayonet pins 36 and inclined slots 38, only one being shown in FIGS. 1 and 3. Typically, three of such bayonet arrangements would be provided around the circumference of the housing.

The lower wall 18 of the housing embodies a downwardly extending annular flange 40 concentric with the center axis of the cylindrical wall 20. A vertical drive shaft 42 is mounted for rotation in the cylindrical bore 44 formed by the flange 40, and extends downwardly below the flange. The lower end of the flange is threadedly engaged with a right angle fitting 46 which is connected to a suitable power source 48, such as an air motor, hydraulic motor or electric motor, shown partially in FIG. 2. The drive shaft of the motor, not shown, is coupled to a shaft 50 in the fitting carrying a bevel gear 52. The bevel gear 52 engages a bevel gear 54 fixedly mounted on the lower end of the drive shaft 42 by a nut 56. Ball bearings 58 in the upper part of the fitting 46 and roller bearings 60 in the lower part of the fitting rotatably support the drive shaft 42 of the tool 10. Preferably, an annular seal 62 surrounds the drive shaft 42 in the flange 40 to seal the lower end of the chamber 26.

A stub shaft 64 is mounted in a vertical bore 66 opening at the top 68 of the enlarged upper free end 70 of the drive shaft in the chamber 26. The bore 66 is offset from the center axis of the drive shaft and, thus, the center axis of the cylindrical chamber 26. The stub shaft embodies an outwardly extending flange 72 which is slidable in a counter bore 73 opening to the top 68 of the drive shaft. A retaining ring 74 above flange 72 retains the stub shaft in the bore 66.

A spring washer 76 is located between the bottom 77 of the counter bore and the flange 72 to bias the stub shaft upwardly for a reason which will be seen later as this description proceeds.

The stub shaft 64 embodies an upper cylindrical portion 80 which extends above the upper surface 68 of the drive shaft. The upper portion 80 extends into a cylindrical recess 82 formed in the bottom of the grinding or polishing wheel 28. The recess 82 is concentric with the center axis of the wheel. The recess is dimensioned so that the wheel will be rotatable on the upper portion of the stub shaft. Thus, it will be appreciated that the stub shaft provides an eccentric driving connection between the drive shaft 42 and the wheel 28.

The wheel 28 embodies a central raised circular portion 84 and an annular surface 86 surrounding the central portion. The annular surface provides the grinding or polishing surface for lapping the workpiece.

Figure 3:
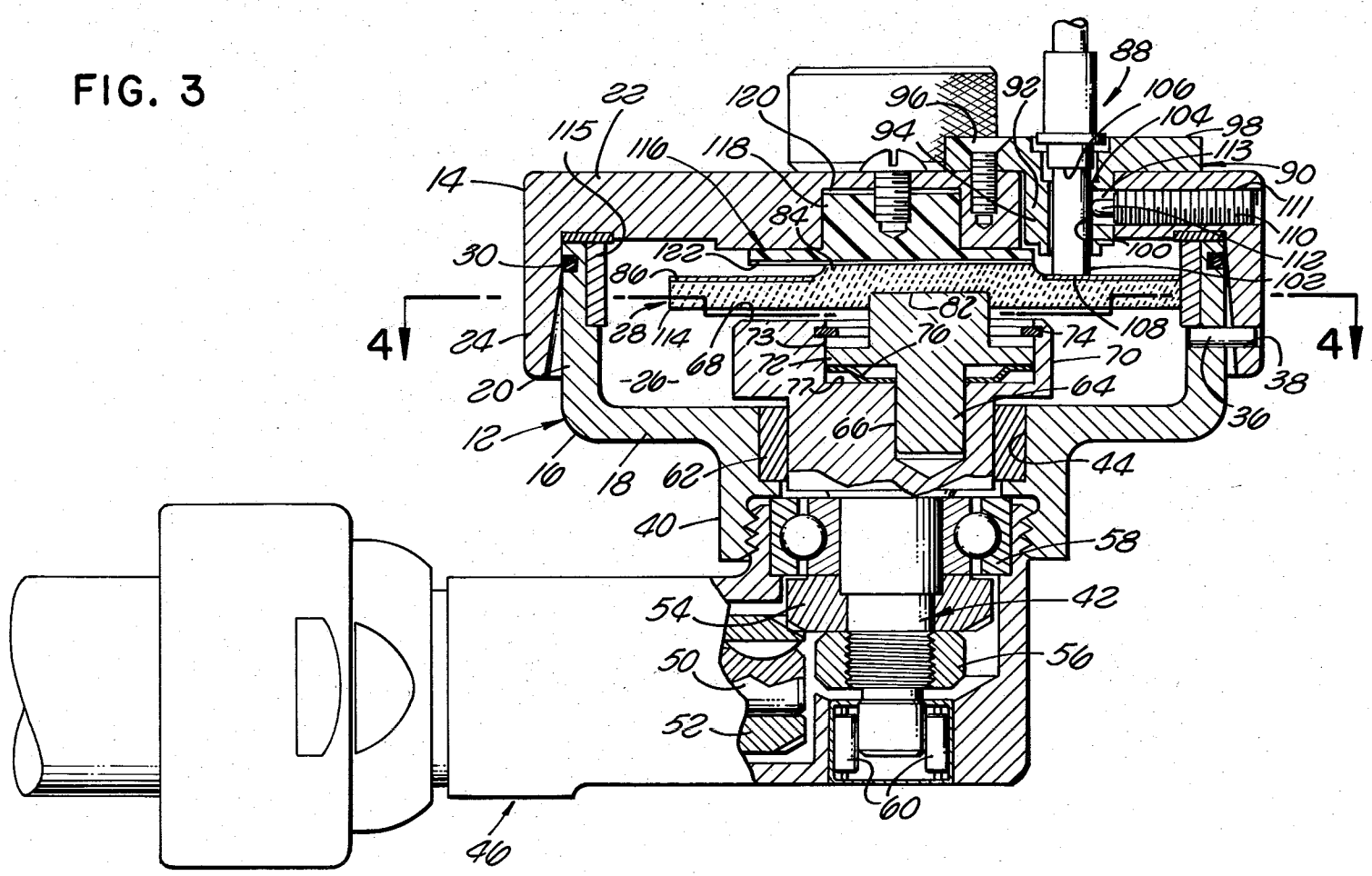
FIG. 3 is a partial longitudinal sectional view of the tool having a fiber optic ferrule mounted therein.

The workpiece, in this instance a fiber optic ferrule 88, is mounted in the upper wall 22 of the housing by means of a ferrule holder 90. The holder is located over the surface 86 of the wheel. The holder has a cylindrical portion 92 which extends downwardly into a bore 94 in the wall 22. Screws 96 extending through a flange 98 on the upper portion of the holder secures the holder to the upper wall 22 of the housing. The holder embodies a central, vertical bore 100 which slidably receives the forward end 102 of the ferrule 88. An annular upwardly facing shoulder 104 is formed in the bore 100, which limits downward movement of the ferrule in the bore by engagement therewith by a downwardly facing annular shoulder 106 on the ferrule. As shown in FIG. 3, the shoulder 106 is above the shoulder 104, which is the position the parts would assume when the ferrule is first inserted into the tool for grinding or polishing the mating end face 108 of the ferrule. As the grinding or polishing operation proceeds, the ferrule is hand fed downwardly into the bore 100 in the ferrule holder until the shoulder 106 abuts the shoulder 104, at which time the lapping operation is completed.

The eccentric driving connection provided between the shaft 42 and the wheel 28 will cause the wheel to be shifted in a rotary path around the chamber 26 of the tool. That is, the center of the wheel will move in a circle having a radius equal to the distance between the center axis of the drive shaft 42 and the center axis of the stub shaft 64. Thus, the wheel 28 is caused to move transversely in a horizontal plane across the chamber 26. It will be appreciated that the holder 90 must be located on the cover 14 of a tool so that the mating end face 108 of the ferrule will be constantly in engagement with the grinding or polishing surface 86 of the wheel 28. Preferably, the central bore 100 of the ferrule holder is positioned a radial distance from the cylindrical wall of the housing 12 equal to one-half of the radius of the wheel, in the embodiment shown, to maximize the grinding and polishing action of the wheel on the end face of the ferrule.

A spring plunger 110 is threaded into a bore 111 in the cover 14 aligned with the bore 100 in the ferrule holder. The forward end 112 of the plunger extends through an opening 113 in the holder 90 to engage one side of the ferrule 88. Thus, the spring plunger serves to urge the ferrule against one side of the bore 100 to avoid any lateral movement of the ferrule in the bore, yet still permit axial sliding movement of the ferrule into the bore by the operator to maintain the mating end face of the ferrule in engagement with the wheel 28.

In order to cause the wheel 28 to rotate about its center axis, there are provided gear teeth 114 on the outer surface of the wheel and matching gear teeth 115 on the interior of the cylindrical wall 20 of the housing. The gear teeth 115 may be machined in the wall or may be provided by a timing belt which is adhered to the wall. As the wheel is shifted in a rotary path around the center axis of the drive shaft 42 by the eccentric drive connection provided by the stub shaft 64, the teeth 114 on the wheel will engage the teeth 115 on the cylindrical wall 20 of the housing to impart rotary motion to the wheel, that is, rotation of the wheel about its own center axis. Thus, the driving arrangement of the present invention produces not only rotary movement of the grinding and polishing wheel about its own center axis, but also transverse movement of the wheel in a horizontal plane as viewed in FIG. 3.

The path of rotation of the wheel 28 with respect to the end of the ferrule 88 changes continuously, resulting in a multi-direction grinding or polishing action on the end face of the ferrule. This will be appreciated by making reference to FIG. 5 which plots a curve developed on the wheel 28 resulting from a marker being inserted through the ferrule receiving bore 100 of the holder 90 and driving the wheel 28 in accordance with the present invention. It will be appreciated that the curve is in the form of a hypocycloid. By providing an odd number of teeth on either the wheel 28 or the wall 20, and an even number of teeth on the other element, the hypocycloid curve will index circumferentially during each full rotation of the wheel 28 about its center axis so that the grinding or polishing surface 86 of the wheel will undergo uniform wear. Thus, it will be appreciated that by the driving arrangement of the present invention, a multi-direction polishing action will be imparted to the end of a workpiece, which will provide a flatter, smoother surface in substantially less time than is possible by use of the automated grinding and polishing tools of the prior art.

As noted previously, it is critical in fiber optic communications that the mating end face 108 of the optical fiber ferrule 88 be precisely perpendicular to the center axis of the ferrule. This requires that the wheel be restrained from wobbling or bouncing and that the grinding or polishing surface 86 thereon be precisely perpendicular to the center axis of the bore 100 in the ferrule holder 90. To this end, the central raised portion 84 of the wheel 28 is precisely machined flat and parallel to the surface 86, thereby providing a bearing surface. A thrust washer 116 is mounted on the underside of the housing cover 14. The thrust washer embodies an upwardly extending boss 118 which extends into a circular recess 120 coaxial with the center axis of the housing 12. The washer is secured on the cover by a screw 122. The diameter of the washer is such that the ferrule 88 mounted in holder 90 is outside the periphery of the washer. The washer may be formed of a self-lubricating material, such as polytetrafluoroethylene (Teflon).

The lower surface 122 of the washer is machined flat and precisely perpendicular to the center axis of the ferrule holder bore 100. Preferably the holder 90 and thrust washer 116 are assembled to the cover 14 of the housing. Thereafter, the lower surface 122 of the thrust washer is machined, such as by milling, to be precisely perpendicular with such axis. Thus, the thrust washer provides a datum or reference surface. The bearing surface 84 on the wheel 28 is maintained in engagement with the reference surface provided by the thrust washer by the resilient action of the spring washer 76 acting on the bottom of the wheel through the stub shaft 64, thereby avoiding wobbling or bouncing of the wheel. The diameter of the thrust washer 116 is sufficiently large so that the bearing surface 84 of the wheel will be constantly in engagement with the thrust washer during the simultaneous rotation and transverse movement of the wheel 28 within the chamber 26. Thus, by this arrangement, even though the wheel 28 moves transversely across the chamber 26 as it is rotating, the grinding or polishing surface 86 thereof is maintained below the ferrule 88 in a plane precisely perpendicular to the center axis of the ferrule thereby assuring that the mating end face 108 of the ferrule will be perpendicular to the center axis thereof.

The machining of the lower surface 122 of the thrust washer also allows a precise distance to be established between the surface and the stop shoulder 104 in the ferrule holder, and consequently, between the shoulder 106 on the ferrule and the grinding or polishing surface 86. Thus, a plurality of ferrules may be ground and polished with the mating end faces of the ferrules located a predetermined, precise distance from the shoulders 114 of the ferrules.

It will be appreciated that the tool of the present invention has the advantage that the cover may be removed and the wheel 28 replaced by a new wheel without change in the datum or reference arrangement due to the spring biased mounting of the wheel upwardly against the thrust washer 116 on the cover. Furthermore, tolerance buildups are minimized by having the reference surface on the cover, rather than on the lower part 16 of the housing.

While the present invention has been described specifically herein as being useful for the grinding and polishing of the end face of a fiber optic ferrule, it will be appreciated that the tool may be utilized for any other workpiece which requires a smooth, flat, precise surface.

We claim:

1. A tool for grinding or polishing a surface of a workpiece such as the mating end of an optical fiber ferrule comprising:

a housing having a chamber therein;

a planar grinding wheel rotatable in said chamber;

means for rotating said wheel, said rotating means causing said wheel to rotate and simultaneously move transversely in the plane in which it lies;

said wheel embodying a grinding and polishing surface, and a raised, flat bearing surface;

said housing embodying a wall facing said bearing surface;

said wall embodying a flat reference surface constantly engageable by said bearing surface during rotation of said wheel in said chamber;

a bore extending through said wall outside of said reference surface and the path of movement of said bearing surface adapted to receive the workpiece and position said surface thereof in engagement with said grinding or polishing surface of said wheel; and means biasing said bearing surface into engagement with said reference surface.

2. A tool for grinding or polishing a surface of a workpiece such as the mating end face of an optical fiber ferrule comprising:

a housing having a chamber therein defined by upper and lower walls and a side wall, said housing being divided into separable upper and lower parts, said upper part embodying said upper wall and said lower part embodying said lower wall;

a rotatable drive shaft extending upwardly through said lower wall into said chamber, said shaft having a free end terminating in said chamber;

said drive shaft embodying an upwardly facing recess;

a stub shaft mounted in said recess and extending upwardly beyond the upper surface of said drive shaft providing a free end terminating in said chamber;

a planar grinding or polishing wheel removably mounted on said free end of said stub shaft;

a recess in the bottom of said wheel rotatably receiving said stub shaft;

said wheel embodying an upwardly facing, raised central portion having a flat smooth bearing surface and a lower annular grinding or polishing surface surrounding said central portion;

said upper wall embodying a flat, smooth reference surface constantly engageable by said bearing surface during rotation of said wheel in said chamber;

a vertical bore extending through said upper wall outside of said reference surface and the path of movement of said bearing surface for receiving the workpiece with said surface thereof in engagement with said grinding or polishing surface of said wheel;

said bore embodying an upwardly facing reference shoulder engageable by a shoulder on the workpiece, said reference shoulder being precisely located above the plane in which said reference surface lies;

said reference surface being precisely perpendicular to the center axis of said bore; and means biasing said bearing surface upwardly into engagement with said reference surface, said biasing means comprising a spring located in said drive shaft recess biasing said stub shaft upwardly.

3. A tool as set forth in claim 2 wherein:

said drive shaft recess is offset from the center axis of said drive shaft.

4. A tool for grinding or polishing a surface of a workpiece such as the mating end of an optical fiber ferrule comprising:

a housing having a chamber therein;

a planar grinding wheel rotatable in said chamber;

means for rotating said wheel including a stub shaft having a free end terminating in said chamber;

said wheel being mounted on said free end of said stub shaft;

the side of said wheel opposite to said shaft embodying a grinding and polishing surface, and a raised, flat bearing surface;

said housing embodying a wall facing said bearing surface;

said wall embodying a flat reference surface constantly engageable by said bearing surface during rotation of said wheel in said chamber;

a bore extending through said wall outside of said reference surface and the path of movement of said bearing surface adapted to receive the workpiece and position said surface thereof in engagement with said grinding or polishing surface of said wheel; and spring means biasing said bearing surface into engagement with said reference surface.

5. A tool for grinding or polishing a surface of a workpiece such as the mating end face of an optical fiber ferrule comprising:

a housing having a chamber therein defined by upper and lower walls and a side wall;

a rotatable drive stub shaft extending upwardly through said lower wall having a free end terminating in said chamber;

a planar grinding or polishing wheel in said chamber mounted on said free end of said shaft;

said wheel embodying an upwardly facing, raised central portion having a flat smooth bearing surface and a lower annular grinding or polishing surface surrounding said central portion;

said upper wall embodying a flat, smooth reference surface constantly engageable by said bearing surface during rotation of said wheel in said chamber;

a vertical bore extending through said upper wall outside of said reference surface and the path of movement of said bearing surface for receiving the workpiece with said surface thereof in engagement with said grinding or polishing surface of said wheel;

said bore embodying an upwardly facing reference shoulder engageable by a shoulder on the workpiece, said reference shoulder being precisely located above the plane in which said reference surface lies;

said reference surface being precisely perpendicular to the center axis of said bore; and spring means biasing said bearing surface upwardly into engagement with said reference surface.

6. A tool as set forth in claim 5 wherein:

said stub shaft is vertically movable; and said spring means engages said stub shaft.

* * * * *